US006122834A

United States Patent [19]

Rester

[11] Patent Number: 6,122,834

[45] Date of Patent: Sep. 26, 2000

[54] COMBINATION FRAMING AND SPEED SQUARE

[76] Inventor: Glenn Steven Rester, P.O. Box 621, Irvington, Ala. 36544

[21] Appl. No.: 08/986,128

[22] Filed: Dec. 5, 1997

[51] Int. Cl.[7] ..... B43L 7/027

[52] U.S. Cl. ..... 33/474; 33/449; 33/780

[58] Field of Search ..... 33/772, 773, 775, 33/780, 781, 782, 449, 474, 479, 482

[56] References Cited

U.S. PATENT DOCUMENTS

| | | | |
|---|---|---|---|
| D. 265,725 | 8/1982 | Ingram | D10/65 |
| 745,171 | 11/1903 | Esbiornson | 33/474 |
| 1,050,969 | 1/1913 | McLeod | 33/420 |
| 2,058,330 | 10/1936 | Little | 33/343 |
| 3,456,353 | 7/1969 | Iams | 33/429 |
| 4,241,510 | 12/1980 | Radecki | 33/613 |
| 4,574,492 | 3/1986 | Miller | 33/427 |
| 4,641,435 | 2/1987 | Brown | 33/427 |
| 4,955,141 | 9/1990 | Welch | 33/418 |
| 5,090,129 | 2/1992 | Cunningham | 33/481 |
| 5,140,755 | 8/1992 | Simmons, Jr. | 33/474 |
| 5,170,568 | 12/1992 | Wright | 33/480 |
| 5,253,426 | 10/1993 | Mosbrucker | 33/429 |
| 5,353,509 | 10/1994 | Black | 33/451 |
| 5,456,015 | 10/1995 | Butcher et al. | 33/451 |
| 5,535,523 | 7/1996 | Endris | 33/371 |
| 5,575,074 | 11/1996 | Cottongim et al. | 33/474 |
| 5,771,897 | 6/1998 | Hopf | 33/474 |
| 5,778,547 | 7/1998 | Wolken | 33/427 |

*Primary Examiner*—Andrew H. Hirshfeld
*Assistant Examiner*—R. Alexander Smith

[57] ABSTRACT

A combination speed and framing square includes first and second legs joined to form a right angle. The first and second legs are substantially longer than those found on a typical framing square allowing higher pitch roof rafters to be sequentially marked in increments of two feet. A third leg is attached to the first and second legs forming the hypotenuse of a right triangle with the first and second legs. The third leg has an elongated marking aperture with hip and valley and common rafter marking indicia on opposing sides thereof as well as incremental angular indicia adjacent its outer edge as with a typical speed square. Level indicators such as bubble levels are disposed on the first and second legs. At each end of the first leg and at a distal end of the second leg is an integral elongated slot each dimensioned to removably receive a rolling measuring device with a digital distance indication means on the exterior thereof. Accordingly, a distance may be quickly and easily measured by rolling the device along a surface and visually reading the display device.

7 Claims, 2 Drawing Sheets

COMBINATION FRAMING AND SPEED SQUARE

BACKGROUND OF THE INVENTION

The present invention relates to a combination framing and speed square for assisting construction workers in measuring and cutting various angles thereby eliminating the burdensome practice of carrying and using two separate tools. Two perpendicularly disposed legs of the device are significantly longer than a conventional framing square so that rafters having a predetermined pitch may be easily marked in increments of two feet. In addition, the device has a plurality of integral level indication means and detachable digital measuring devices for quickly and conveniently measuring non-linear or protracted surfaces.

DESCRIPTION OF THE PRIOR ART

Speed squares, framing squares and the like are generally known in the prior art. The devices are generally right triangular or right angular in shape and have various measuring and marking indicia thereon. For example, U.S. Pat. No. 5,140,755 issued to Simmons, Jr. relates to a square designed to conveniently layout wall stud positions having a desired center to center spacing therebetween. The device has a long arm which may be sixteen or twenty four inches long and one inch wide and a short arm perpendicular thereto the length of which is either one and a half inches long, equal to the width of a stud, or equal to one half of the stud width.

U.S. Pat. No. 5,456,015 issued to Butcher et al discloses a multi-purpose rectangular framing square having means for attaching a tape measure thereto.

U.S. Pat. No. 5,575,074 issued to Cottongum et al relates to a triangular speed square a side of which has a T-shaped cross-sectional area with integral wrenches thereon.

U.S. Pat. No. 5,535,523 issued to Endris relates to a carpenter's square comprising a pair of detachable legs one of which has a longitudinal recess for receiving the portion of a steel track that extends over a metal stud. The stud may then be aligned and oriented relative to the track while the stud is being secured thereto. The device also has one or more levels mounted to one of the legs to verify proper relative orientation of the stud and the track.

U.S. Pat. No. 5,253,426 issued to Mosbrucker relates to a multi-purpose square comprising a handle having an integrated level and two legs perpendicularly extending therefrom. One leg has linear and angular measurement indicia thereon with holes disposed selectively along its length for receiving a marker. The other leg has angular measurement and pitch indicia thereon.

U.S. Pat. No. 5,170,568 issued to Wright relates to a right triangular roofing speed square with indicia on an edge thereof corresponding to specified roof unit rise values. The indicia are oriented such that the scale used for common rafter cut marks is right side up relative to the carpenter.

U.S. Pat. No. 4,241,510 issued to Radecki relates to an T-shaped device for hanging pictures comprising cross arms and a neck part. Slide members are provided on the cross arms to engage a hanging wire. Locating marks are disposed on the neck part to indicate the top of a picture and to position it at a desired wall location. Although speed squares, framing squares and the like exist in the prior art, the present invention provides a combination of the two that is simple and convenient eliminating the practice of carrying and using two separate tools. Also, only one leg of a conventional framing square is typically sixteen inches or twenty four inches. The present invention provides a combination framing and speed square in which two perpendicularly attached legs are each twenty four inches long. The two twenty four inch legs allow a user to step quickly off rafter lengths in two feet increments when the desired pitch is greater than 8/12 which cannot be practically accomplished with conventional framing squares. Although conventional framing and speed squares have measuring indicia thereon, the devices are not practical for measuring long distances or non-linear surfaces such as peripheries. In such event, a separate tool such as a measuring tape must be used which is cumbersome and often requires the use of both hands, a marking tool or perhaps another person. The present invention overcomes this problem by providing a speed/framing square having a small, compact removably attached measuring device which rollably engages a surface to be measured while simultaneously displaying the measured distance on an LCD screen.

SUMMARY OF THE INVENTION

The present invention relates to a unitary, multi-purpose tool that has the features and advantages of both a framing and speed square and which overcomes the disadvantages of the prior art enumerated above. The device comprises a first elongated substantially planar leg having a second substantially planar leg perpendicularly extending from an end thereof. Preferably, the first leg has a plurality of measurement indicia such as one inch calibrations and fractions thereof adjacent its outer edge. The second leg also has a plurality of measurement indicia proximal an inner edge. A third leg extends diagonally from the first leg to the second leg forming a right triangular opening therebetween. On the third leg is an elongated marking orifice having hip and valley rafter marking indicia adjacent a side and common rafter marking indicia adjacent an opposing side. Angular indicia are disposed along an outer edge such that the third leg resembles the hypotenuse of a right triangular speed square. The first and second legs each have a level indication means such as a bubble level thereon.

Proximal the intersection of the first and second legs as well as at each of their distal ends are integral longitudinal slots dimensioned to receive a rollable measuring device. The measuring device is substantially cylindrical with a liquid crystal display on its exterior surface. A measurement wheel protrudes from the measuring device and is in communication with an internal counter and the display. The device is programmed such that the numeral on the display sequentially increases for each predetermined length of surface that the wheel traverses. The counter/display may be selectively reset to a predetermined value using a reset button on the measuring device exterior surface. Extending from an end of the measuring device is an elongated substantially rectangular neck dimensioned to be tightly received within any of the slots.

Accordingly, the present invention provides a combination speed and framing square that can quickly and easily measure an indeterminate distance. It is therefore an object of the present invention to provide a combination framing and speed square which is larger than conventional framing squares thereby allowing a roofer to mark rafters in increments of two feet when the desired roof pitch is greater than 8/12.

It is yet another object of the present invention to provide a combination framing and speed square having removably attached digital measurement devices.

It is yet another object of the present invention to provide a combination framing and speed square which has integral level indicating means thereon.

It is yet another object of the present invention to provide a combination roofing and framing square that eliminates the need for a roofer to carry and use two separate tools when framing and/or roofing a building. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
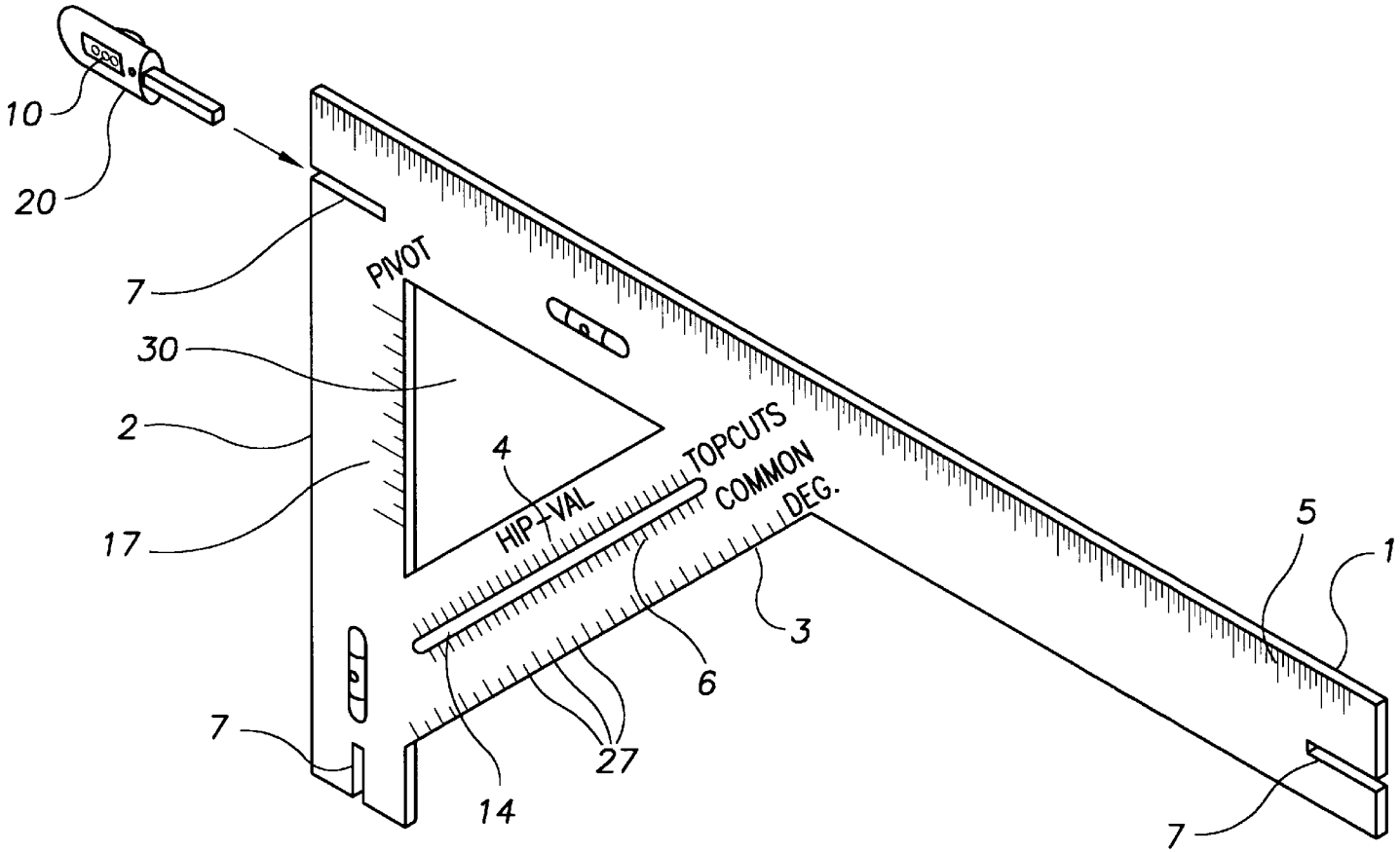
FIG. 1 depicts the inventive device.
Figure 2:
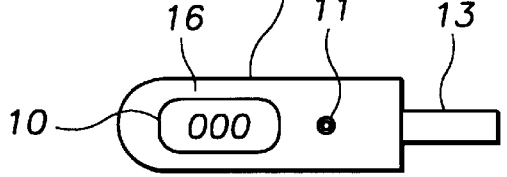
FIG. 2 is a top view of the measuring device.
Figure 3:
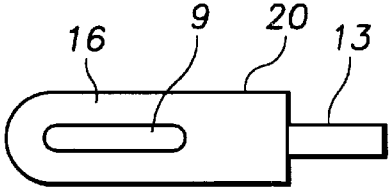
FIG. 3 is a bottom view of the measuring device.
Figure 4:
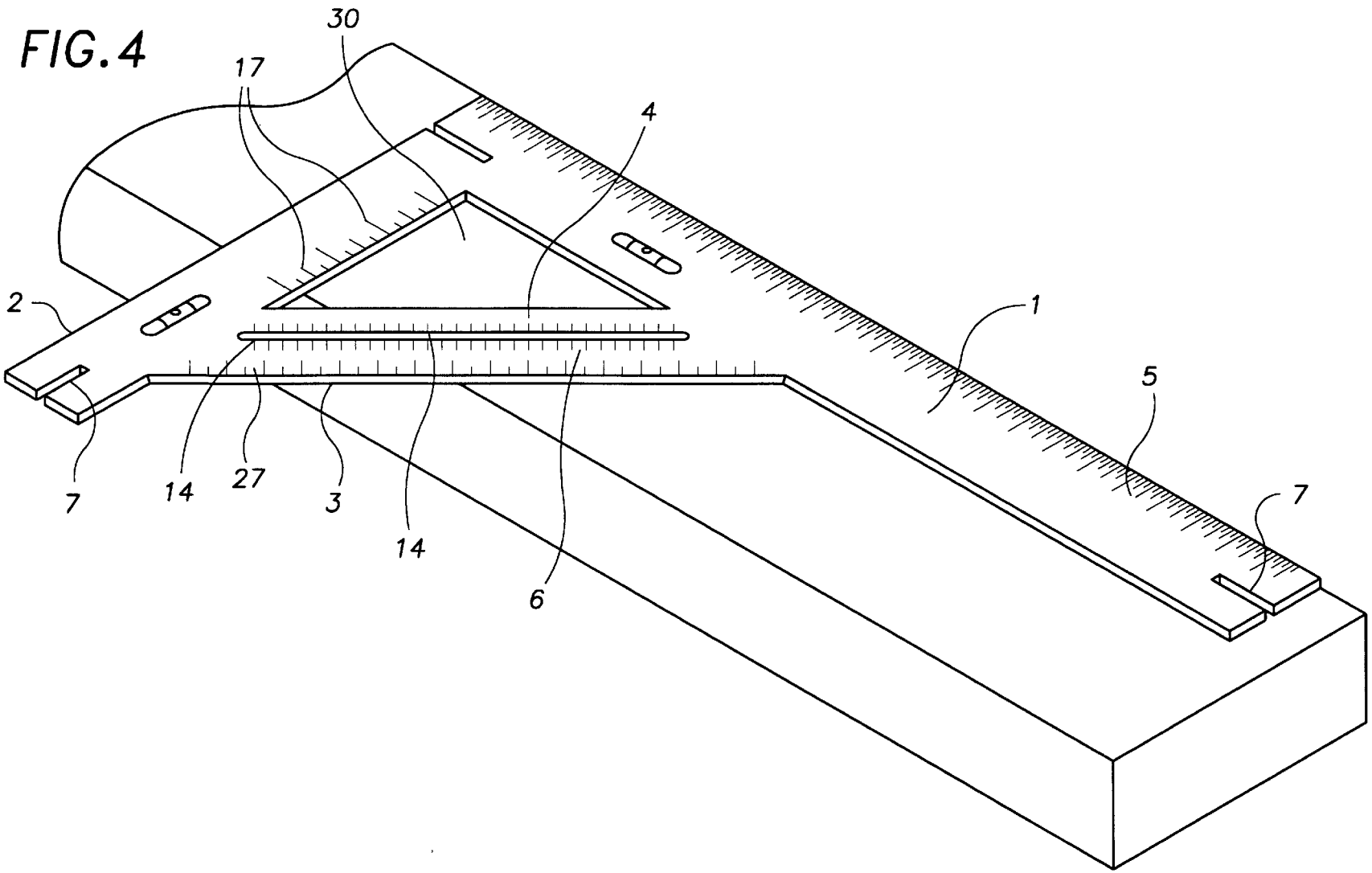
FIG. 4 depicts a preferred embodiment of the inventive device in which the first and second legs are each approximately twenty four inches long.

Referring now to FIGS. 1 through 3, the present invention relates to a combination framing and speed square designed to facilitate stepping off two feet rafter lengths when the roof pitch is greater than ½. The device comprises a first substantially planar leg 1 with a second substantially planar leg 2 perpendicularly extending from an end thereof. Both the first and second legs each have a free distal end and inner and outer edges. The intersection of the inner edge of the first and second legs define a pivot point around which the device is rotated when making various cut marks according to a desired roof pitch.

A third leg 3 having an outer edge diagonally extends from the first leg 1 to the second leg 2 forming a right triangular opening 30 therebetween. The third leg 3 is attached to the first 1 and second legs 2 at a predetermined distance from their respective distal ends as depicted in FIG. 1 thereby combining the physical features of a framing square with that of a speed square.

In the preferred embodiment, the length of the first leg 1 and the second leg 2 is approximately twenty four inches which allows a roofer to mark rafter lengths in increments of two feet when the rafter pitch is greater than ½. With conventional framing squares in which only one leg is sixteen or twenty four inches, marking the higher pitch roofs in two feet increments is not practical. Preferably, the first leg 1 is 2 inches wide and the second leg 2 is 1½ inches wide. However, as will be readily apparent to those skilled in the art, the dimensions of the first and second legs may be varied to suit a particular application without departing from the concept of the invention, i.e. a combination framing and speed square.

Along the outer edge of the first leg 1 are a plurality of measurement indicia 5 arranged sequentially in one inch increments and fractions thereof. In the preferred embodiment, a scale from 0 to 24 inches is provided allowing a user to measure and mark a rafter in increments of two feet. Along the inner edge of the second leg 2 adjacent a side of the triangular opening are likewise a plurality of measurement indicia 17. Preferably, the measurement indicia 17 are disposed in ¼ inch intervals for precisely measuring smaller distances.

The third leg 3 has an elongated marking aperture 14 with hip and valley marking indicia 4 on a side thereof and common rafter marking indicia 6 on an opposing side. Along the outer edge of the third leg are a plurality of incremental angle measurements 27 similar to that found along the hypotenuse of a conventional triangular speed square.

At each end of the first leg and at the distal end of the second 2 leg is an integral elongated slot 7 for receiving a measurement device 20. Each measurement device 20 comprises a substantially cylindrical housing 16 having two ends with a roller 9 protruding from its exterior surface. The roller 9 is in communication with an internal digital counter device (not pictured) the output of which sequentially increases for every inch of linear distance that the roller traverses. As will be readily apparent to those skilled in the art, the counter may be calibrated to incrementally increase for any given distance that the roller traverses. The digital counter is of the type generally know in the prior art found in a variety of devices such as electronic equipment, games and similar items.

On the exterior surface of the cylindrical housing 16 is a liquid crystal display 10 in communication with the counter for visually displaying the distance measured as indicated by the counter output. A reset button 11 is disposed on the exterior surface of the housing and is in communication with the digital counter for resetting the display and counter to a predetermined value such as zero. Extending from an end of the housing is a substantially rectangular neck 13 dimensioned to be tightly received within any of the elongated slots 7 on the first 1 and second 2 legs. Accordingly, one or more measurement devices may be attached to any of the elongated slots and rolled across a surface to be measured while the measured distance will be simultaneously displayed on the screen 10.

Preferably, the legs of the inventive device are manufactured with anodized aluminum, plastic or a similar lightweight, corrosion resistant material. The shape, size and color of the distal measuring device may be varied and it may be manufactured using any number of suitable materials. Although there has been shown and described the preferred embodiment of the present invention, it will be readily apparent to those skilled in the art that modifications may be made thereto which do not exceed the scope of the appended claims. Therefore, the invention is to only be limited by the following appended claims.

What is claimed is:

1. A combination speed and framing square comprising:

a first, substantially planar leg having first and second ends with a slot at each end thereof and a plurality of measurement indicia disposed thereon;

a second, substantially planar leg perpendicularly extending from the first end of said first leg, said second leg terminating at a distal end having a slot therein, said first and second legs having sufficient length to mark incremental rafter lengths having a predetermined pitch;

a third, substantially planar leg having a plurality of incremental angular measurement indicia thereon, said third leg extending from an inner edge of said first leg and spaced a predetermined distance from said second end to an inner edge of said second leg and spaced a predetermined distance from said distal end, said third leg having an elongated marking aperture with a plurality of rafter marking indicia on opposing sides thereof thereby providing a unitary tool which functions as both a framing and speed square;

a distance measuring means removably receivable within any of said slots, said distance measuring means including a substantially hollow housing having an exterior surface with a roller protruding therefrom for rollably traversing a surface to be measured; a counter means received within said housing and in communication with said roller, said counter means preprogrammed to count sequentially for a predetermined distance traversed by said roller; a digital display means on the exterior surface of the housing in communication with said counter means for visually displaying an output of said counter means and thus the distance traversed by said roller; and, a substantially rectangular neck extending from the exterior surface of said housing dimensioned to be received within each of said slots.

2. A device according to claim 1 wherein said first and second legs each have a level indication means thereon.

3. A device according to claim 2 wherein said level indication means comprises a bubble level.

4. A device according to claim 1 wherein said rafter marking indicia comprise hip and valley rafter marking indicia on a side of said aperture and common rafter marking indicia on an opposing side thereof.

5. A device according to claim 1 wherein said measuring means has a reset means on the exterior surface of said housing in communication with said counter means for resetting said counter means and said display means to a predetermined number.

6. A device according to claim 1 wherein the length of said first leg is approximately twenty four inches.

7. A device according to claim 6 wherein the length of said second leg is approximately twenty four inches.

* * * * *